United States Patent [19]

Braemert et al.

[11] Patent Number: 5,010,614

[45] Date of Patent: Apr. 30, 1991

[54] ARTICULATED BRIDGE GANGWAY BETWEEN RAILROAD CARS

[75] Inventors: Peter Braemert, Wolfenbuttel; Ingo Britzke, Kassel, both of Fed. Rep. of Germany

[73] Assignee: Hubner Gummi - und Kunststoff GmbH, Kassel, Fed. Rep. of Germany

[21] Appl. No.: 399,767

[22] Filed: Aug. 28, 1989

[51] Int. Cl.[5] ..... E01D 1/00

[52] U.S. Cl. ..... 14/71.1; 104/20; 105/425; 105/458; 14/69.45

[58] Field of Search ..... 14/69.5, 70, 71.5, 71.1; 104/31, 20; 105/436, 458, 17, 15, 10, 3, 402, 397, 396, 425, 8.1

[56] References Cited

U.S. PATENT DOCUMENTS

| | | | |
|---|---|---|---|
| 1,794,516 | 3/1931 | Gunn et al. | 105/15 |
| 2,184,298 | 12/1939 | Groff | 105/8.1 |
| 2,788,751 | 1/1956 | Russell | 14/69.5 |
| 3,922,971 | 12/1975 | Maroshick | 105/8.1 |
| 4,241,665 | 12/1980 | Kleim | 105/8.1 |
| 4,252,065 | 2/1982 | Bickel et al. | 105/10 |
| 4,539,912 | 9/1985 | Hassel et al. | 105/8.1 |
| 4,579,063 | 4/1986 | Losa et al. | 105/8.1 |
| 4,644,872 | 2/1987 | Vianello et al. | 105/8.1 |
| 4,690,067 | 9/1987 | Kuker et al. | 105/8.1 |
| 4,690,068 | 9/1987 | Delfourne | 105/8.1 |
| 4,690,421 | 9/1987 | Schmidt et al. | 105/8.1 |
| 4,736,688 | 4/1988 | Ando et al. | 105/8.1 |
| 4,781,123 | 11/1988 | Yoshihara | 105/8.1 |
| 4,802,417 | 2/1989 | Kuker et al. | 105/8.1 |

FOREIGN PATENT DOCUMENTS

| | | | |
|---|---|---|---|
| 947078 | 8/1956 | Fed. Rep. of Germany | 105/458 |
| 958658 | 2/1957 | Fed. Rep. of Germany | 105/458 |

*Primary Examiner*—Ramon S. Britts
*Assistant Examiner*—Roger J. Schoeppel
*Attorney, Agent, or Firm*—Alan H. Levine

[57] ABSTRACT

An articulated bridge as a component of a detachable gangway floor plate between two articulated interconnected railroad cars, the bridge being provided with several elongated bridge elements arranged in succession laterally, and running transverse to the direction of the bridge. The articulated extremities of the bridge are defined by the side walls of a frame approximately following the contours of the bridge. One end section of the bridge is designed for attachment to one of the two interconnected railroad cars and the other end section of the bridge is designed for attachment to the corresponding end section of an articulated bridge of the other of the two interconnected railroad cars, both end sections running in the transverse direction of the bridge. The end section of the frame runs in the transverse direction of the bridge, which is allocated to one of the interconnected railroad cars, and is carried in a carriage which is adjustable in a trough of the railroad car, in the longitudinal direction of the bridge, in a path of positioning movement derived from the longitudinal clearance of the coupling between the two railroad cars.

12 Claims, 4 Drawing Sheets

ARTICULATED BRIDGE GANGWAY BETWEEN RAILROAD CARS

Articulated bridges of the general type to which this invention relates are known (see for example German disclosure documents 3 305 062 and 3 401 298).

Articulated bridges of this type offer the advantage that, due to their diagonal adjustability, they do not impair the operation of the railroad car, and enable passengers optimal crossing from one car to another.

It is the objective of this invention to develop a practical articulated bridge with respect to both application and interconnectibility. By the term "application" is to be understood the allocation of the gangway floor plate to an interconnected car, or a car which is to be interconnected. These difficulties must, in particular, be taken into consideration, because the bridge must, on the one hand, be solidly and reliably supported by the car and, on the other hand, the relative motion between the two interconnected cars in the longitudinal direction of the cars must be taken into consideration. The relative motion results from the clearance occurring in the coupling device between the two cars and is not to be absorbed by the bridge itself. The reason is that this would considerably complicate the design of the bridge, which is not desirable, because the bridge must be relatively versatile, in order to absorb the remaining relative motions occurring between the two cars.

By the term "interconnectibility" is meant that two bridges, which jointly bridge the gap between interconnected cars, must be detachably interconnected at the center between the two cars. Such a detachable connection or coupling is essential in order to interconnect or detach cars within the train from one another, and to employ those cars as rear carriages in two different trains. In the latter application, the articulated bridges are folded upward. In addition, it is necessary to so provide this interconnectibility that the front ends of two cars can be interconnected irrespective of the sequence in which a multitude of cars is arranged within a train. To achieve the objective of this invention, the invention deals with the potential of connecting or supporting gangway foot plates in accordance with the aforesaid prior art.

In the following description, the invention is explained in detail with reference to the accompanying drawings. In the drawings.

Figure 1:
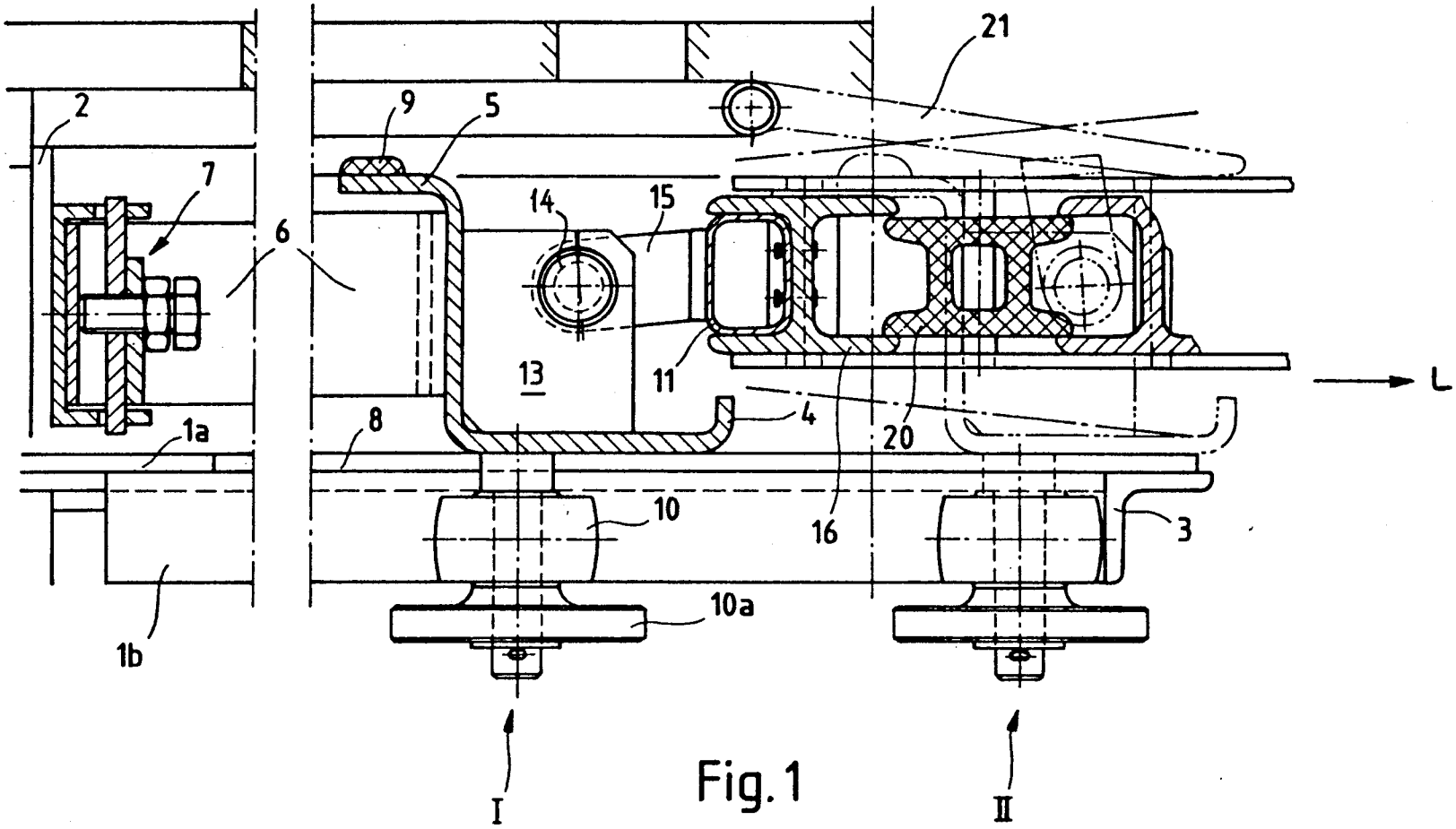
FIG. 1 shows one end of an articulated bridge in accordance with this invention, which faces two interconnected cars.

At the front end of a railroad car, a transverse trough is attached to the bottom frame of the car, or embedded therein at the front end. The trough comprises two lateral angular rails 1 (FIGS. 1 and 5), a relatively high rear wall 2 interconnecting the angular rails 1, and an angular rail 3 which also interconnects the two angular rails 1. This is a welded sheet metal construction which by means of the rear wall 2 is detachably or, by conventional means, permanently affixed to the railroad car.

The trough carries a carriage 4, adjustable in the longitudinal direction of the car (arrow L in FIGS. 1 and 3), whose path of positioning movement results from the travel of the spring within the coupling which is allocated to the railroad car in the usual manner and with which the car is connected with the next car. The carriage 4, when viewed from its side, has a U-shaped cross-section with a high rear wall and a lower front wall. At the upper extremity of the rear wall, there is attached a horizontal gib 5 turned toward the outside.

The positioning movement of the carriage 4 is limited toward the front by the angular front rail 3 of the trough. The positioning movement of the carriage toward the wall 2 is counteracted by a leaf spring 6 whose center is retained in a bearing 7 at the rear wall 2 of the trough 1-3 and whose two concave extremities rest against the carriage 4. The leaf spring 6 is so designed and arranged that it is increasingly loaded as the carriage 4 moves away from the wall 2 of the trough. In order to prevent overloading of the spring 6, the gib 5 can be so balanced that at one end off the path of positioning movement of the carriage 4 it pushes against the rear wall 2 of the trough, just before the spring 6 reaches its maximum load.

Figure 5:
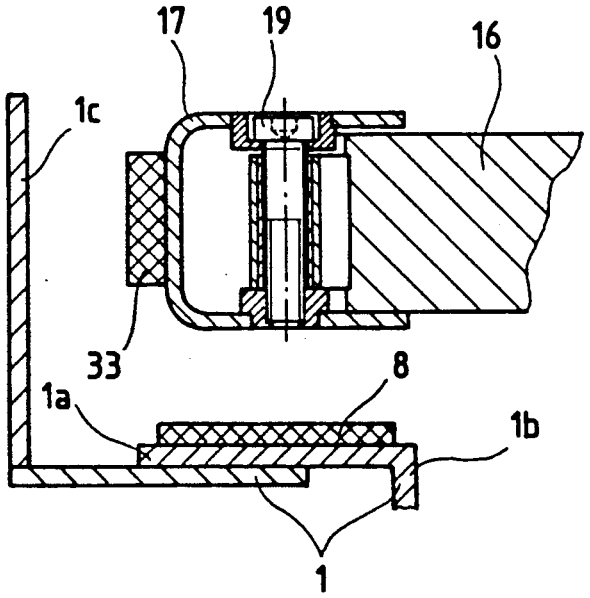
FIG. 5 shows a sectional view taken along line A—A in FIG. 3.

For reducing sliding friction, the horizontal legs **1*a* of the angular rails within the area of positioning movement are lined with a friction-reducing lining 8 (FIGS. 1 and 5). At the horizontal legs 1*a* of the angular rails 1, the carriage is supported by the linings 8. In order to prevent the carriage 4 from tilting around its longitudinal axis, a sliding pad 9 is attached at each extremity of the gib 5, and by these pads at both extremities of the gib 5 the carriage is supported by an upper plate 5*a*** which also interconnects the angular rails.

The lateral guiding of the carriage 4 is aided by rollers 10. The front end of each roller is carried at the underside of the carriage, is freely rotatable around a vertical axis, and is supported by a downward section **1*b* at one of the lateral rails 1. At the lower extremity of the vertical axis a disc 10*a* is arranged at a specific distance so that the disc comes to rest against the underside of the section 1*b* of the respective lateral angular rail 1, if the carriage 4** in this area is adjusted unduly high.

A rigid low frame is carried by two bearings staggered in transverse direction of the car, the frame being provided with a rear transverse tube 11. Each bearing comprises two parallel end shields 12 and 13 between which a transverse journal 14 is carried. A tongue 15 is pivoted on journal 14, the front end of the tongue being connected to the transverse tube 11. The rear extremities of the end shields 12 and 13 are affixed to the rear wall of the carriage 4.

On the transverse tube 11, there is affixed the first of several successive bridge elements 16. Each of these bridge elements is an I-section. The two rear flanges of the first bridge element engages the top and bottom of the transverse tube 11, or its parallel top and base surface, and the rear surface of the web of the bridge element rests against the front of the two parallel side walls of the transverse tube 11, which appears rectangular when viewed in cross-section (FIG. 1).

Figure 2:
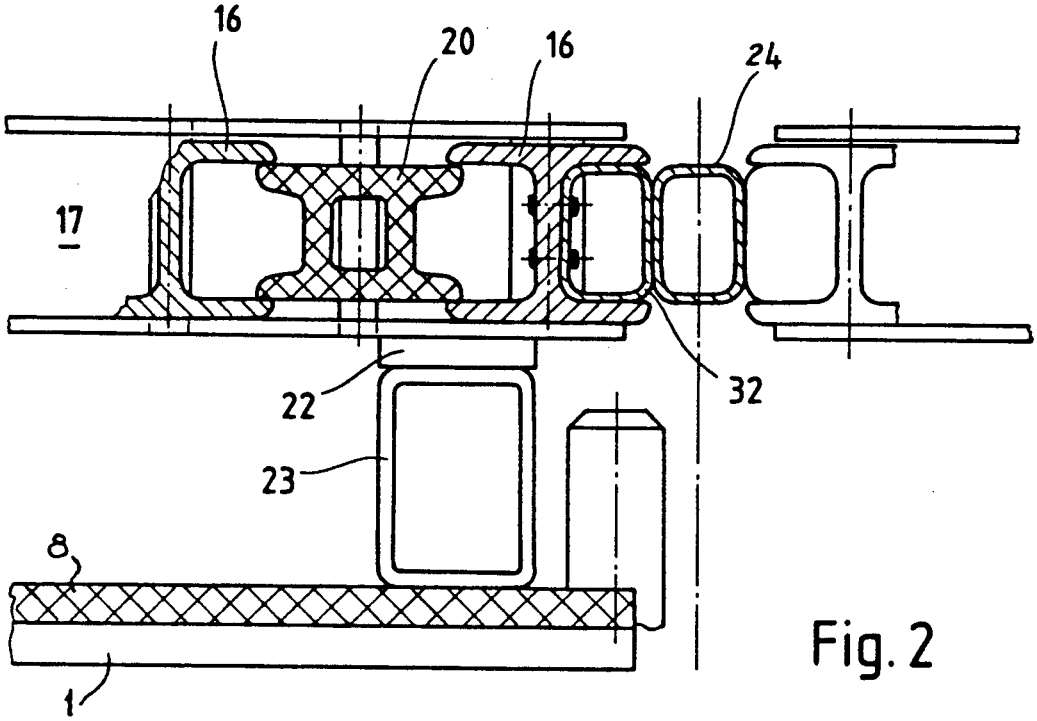
FIG. 2 shows the other end of an articulated bridge in accordance with this invention, which is coupled with the corresponding "other" end of a second articulated bridge of a car coupled with the first car, the second articulated bridge also being in accordance with this invention.
Figure 3:
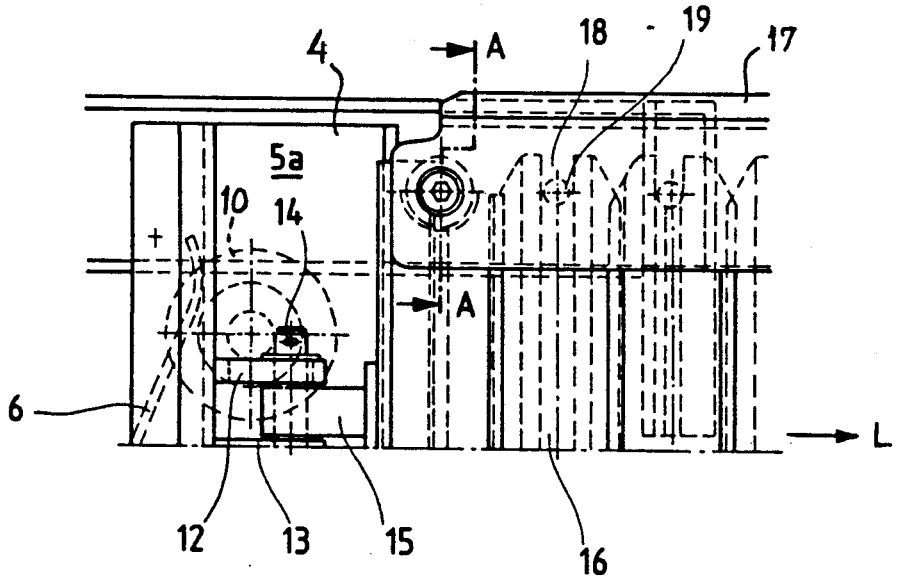
FIG. 3 shows a top view of the bridge shown in FIG. 2, on a different scale.
Figure 4:
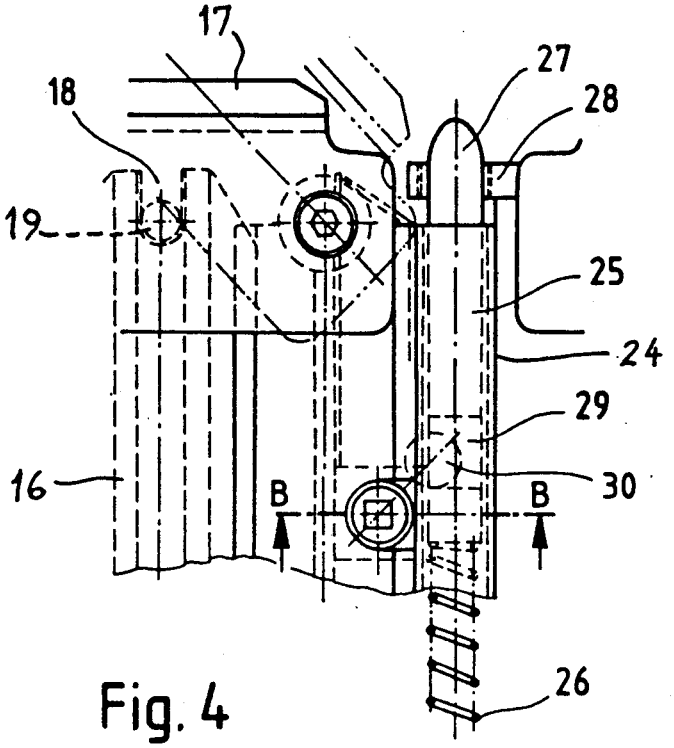
FIG. 4 shows a top view of the bridge shown in FIG. 2, again on a different scale.

The bridge elements 16, which are similar in cross-section and length, are held at both ends between the flanges of the side walls 17 of the frame, which are I-shaped when viewed in cross-section (FIGS. 2 and 5). The side walls 17 of the frame have horizontal flanges located opposite each other, so that the bridge elements can be held between those flanges. At their extremities, the flanges of the bridge elements are slightly longer than the webs, and are provided with slits 18 (FIGS. 3 and 4). The bridge elements, by means of slits 18, grasp the journals 19 held in the flanges of the side walls 17. By this means, the bridge elements 16 can be hinged between the flanges of the side walls 17. The bridge elements preferably are comprised of aluminum profiles whose surface is provided with a friction-increasing lining.

Between each of the successive bridge elements 16, an intermediate element 20 is held. The intermediate elements basically have the same cross-section as the bridge elements 16; however, they are preferably made of a plastic material. For this reason, they have a correspondingly greater wall thickness, and the web is double-walled or developed as a chamber profile. In addition, the intermediate elements are shorter than the bridge elements, so that they can be retained in the space between the two flanges of a bridge element. Also, the elements are provided with slits at their extremities, and each slit grasps a journal of a side wall 17.

In order to avoid the formation of steps in the end section of the articulated bridge relating to the railroad car, a transition plate 21 (FIG. 1) is swivel-mounted at the railroad car, the open end of said transition plate being loosely supported by the bridge. The articulated bridge, which faces away from the railroad car, is placed over a non-abrasive lining 22 upon a support traverse 23, which is a component of the central buffer coupling between this and the succeeding railroad car. The succeeding railroad car carries a similar bridge in the same manner, and in the area of the center buffer coupling both bridges are detachably coupled, so that both halves form a continuous gangway floor plate.

In order to detachably couple the two bridge halves with one another, the two bridge halves are designed as follows. The two bridge halves at one side of a perpendicular plane passing through the railroad car will be described, the configuration on the other side of the longitudinal plane being similar. The sections comprising "one" side of "one" of the bridge halves are also found on the other side of the longitudinal plane of the "other" bridge half and vice versa, so that the railroad cars can be interconnected in any alternating order.

Figure 6:
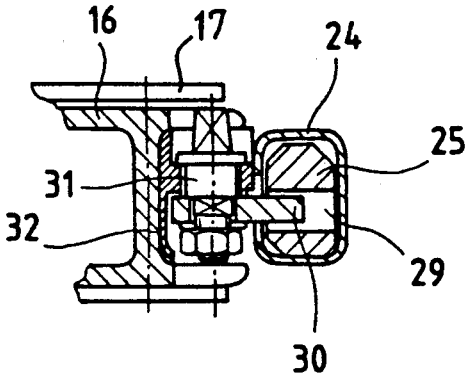
FIG. 6 shows a sectional view taken along line B—B in FIG. 4.
Figure 7:
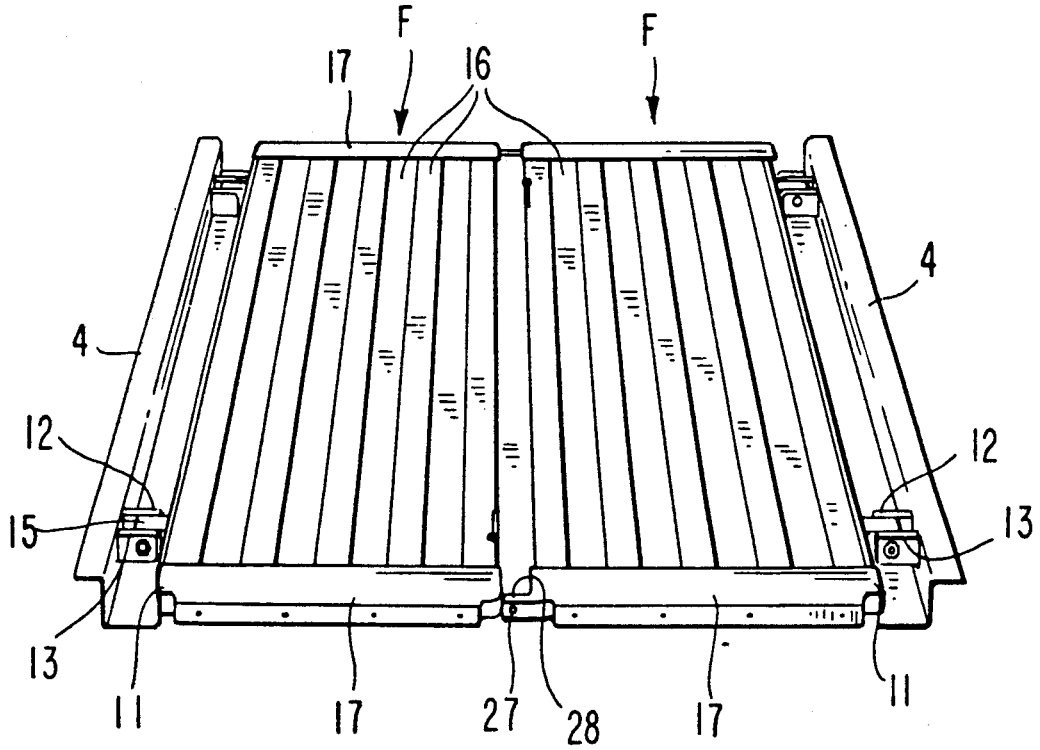
FIG. 7 is a perspective view of two interconnected floor plates F of the bridge, each floor plate being connected to a carriage.

At the last bridge element 16, a tube 24 (FIG. 6), which appears rectangular when viewed in cross-section, is attached, the tube running parallel to the bridge element, the latter extending approximately to the aforesaid vertical longitudinal plane, but not projecting beyond that plane. Tube 24 accommodates an interlock 25 (FIG. 4) which is adjustable under the influence of a spring 26 or against the action of the spring. At its end near the side wall of the car, the conical head 27 of interlock 25 projects into an interlock holding fixture 28 allocated to the other end of the bridge half. Fixture 28 is a punched metal plate supported at the other half of the bridge. In this interlocking position of the interlock 25, spring 26 is completely or largely released.

In order to separate the two bridge halves from one another, the interlock 25 must be pushed out of the interlock holding fixture 28. For this purpose, a finger 30 projects into a pocket 29 of the interlock 25. Finger 30 is located on a vertical journal 31, which is rotatable around its longitudinal axis, so as to swivel the finger 30 and thereby slide the interlock 25. In order to rotate journal 31, it is shaped at its upper extremity in the form of a square which can be engaged by a suitable key fitted through an aperture in the upper flange of the last bridge element. The journal 31 is fitted on to a second tube 32, corresponding to the tube 24 and located, between the tube 24 and the bridge element 16.

The articulated bridge in accordance with the invention offers a multitude of advantages. The transverse displacement between the two railroad cars can be absorbed by the articulated bridge, because the bridge is adjustable in diagonal directions. The displacement is limited when one of the side walls 17, by means of a rubber buffer 33, comes to rest at the external vertical section 1*c* of trough 1. The vertical displacement between the two railroad cars can be absorbed by the joints. These joints also enable the bridge to be folded upward toward the end wall of the car. Longitudinal displacements, occuring at a distance between two interconnected cars due to coupling clearance, are absorbed by the troughs through the movement of the carriages of two interconnected bridges. The two bridges are centered by means of the springs 6 located in the center between the two cars. In FIG. 1, one of the end positions of the bridge is designated as I, and the other as II.

We claim:

1. An articulated bridge component for use in cooperation with another similar bridge component to span the space between two interconnected railway cars, comprising:

two laterally-spaced-apart side rails extending from one end of a railway car in the longitudinal direction of the car, a floor plate including a frame having two side walls, and a plurality of bridge elements extending between the frame side walls and transverse to the longitudinal direction of said car;

means associated with the end of the floor plate remote from said car for interconnecting the floor plate with a similar floor plate extending from a second car coupled to said car, a carriage slidable along the side rails in a direction toward and away from said car, and means for interconnecting the carriage with the end of the floor plate nearest said car, so that the carriage and floor plate are movable together toward and away from said car in order to compensate for relative motion between two coupled cars in the longitudinal direction of the cars.

2. An articulated bridge component as defined in claim 1 including resilient means constantly urging the carriage and floor plate in the longitudinal direction of, and away from, said car.

3. An articulated bridge component as defined in claim 2 including means carried by the side rails for limiting the movement of the floor plate in a direction away from said car.

4. An articulated bridge component as defined in claim 2 including a back wall extending between the side rails, and wherein the resilient means is a leaf spring secured at its center to the back wall, the ends of the spring engaging the carriage.

5. An articulated bridge component as defined in claim 1 wherein the carriage and floor plate are pivotally interconnected about a horizontal axis.

6. An articulated bridge component as defined in claim 1 wherein the carriage slides upon a surface of each side rail, and including a friction-reducing material covering said surface.

7. An articulated bridge component as defined in claim 1 including rollers depending from the carriage and rotatable about vertical axes, the rollers engaging and movable along the lengths of the side rails to limit movement of the carriage in a direction transverse to the longitudinal direction of the railway car.

8. An articulated bridge component as defined in claim 1 wherein the means for interconnecting the floor pate with a similar floor plate of a second car, includes a holding fixture projecting from the end of the floor plate remote from said car, and an interlock mounted on the end of the floor plate remote from said car, the interlock being slidable in a direction transverse to the longitudinal direction of said car, and the interlock having a head adapted to enter the holding fixture projecting from the floor plate of a second car coupled to said car.

9. An articulated bridge component as defined in claim 8 including resilient means constantly urging the interlock in a direction in which it engages the holding fixture.

10. An articulated bridge component as defined in claim 8 including a tube mounted on the end of the floor plate remote from said car, the interlock being slidable within the tube, and manually operable means extending through an opening in the side wall of the tube for sliding the interlock so that the latter can engage, or disengage from, the holding fixture.

11. An articulated bridge component as defined in claim 10 wherein the tube is located below the plate of the upper surface of the floor plate, and the manually operable means includes a portion engageable from above that plane.

12. An articulated bridge component as defined in claim 11 wherein the manually operable means includes a lever extending through the opening in the tube, and a journal rotatable about the pivot axis of the lever, the journal being exposed for manipulation from above the plane of the upper surface of the floor plate.

* * * * *